United States Patent [19]

McLane et al.

[11] Patent Number: 4,545,422

[45] Date of Patent: Oct. 8, 1985

[54] MACHINE FOR CONTINUOUSLY CASTING BATTERY GRIDS

[75] Inventors: Jack E. McLane, Port Huron; Raymond L. Schenk, Marysville, both of Mich.

[73] Assignee: Wirtz Manufacturing Company, Inc., Port Huron, Mich.

[21] Appl. No.: 543,493

[22] Filed: Oct. 19, 1983

[51] Int. Cl.[4] ..... B22D 11/10

[52] U.S. Cl. ..... 164/429; 164/438; 164/133; 164/479

[58] Field of Search ..... 164/479-482, 164/427-434, 437-440, DIG. 1, 133, 135, 337; 264/328.1, 328.2, 328.11, 328.12, 328.19; 425/555

[56] References Cited

U.S. PATENT DOCUMENTS

| | | | |
|---|---|---|---|
| 382,319 | 5/1888 | Norton et al. | 164/428 |
| 4,349,067 | 9/1982 | Wirtz et al. | 164/479 |
| 4,509,581 | 4/1985 | McLane et al. | 164/479 |

*Primary Examiner*—Nicholas P. Godici
*Assistant Examiner*—Kenneth Berg
*Attorney, Agent, or Firm*—Barnes, Kisselle, Raisch, Choate, Whittemore & Hulbert

[57] ABSTRACT

A machine for casting battery grids continuously includes a rotary, cylindrical drum in the outer peripheral surface of which the battery grid cavity is machined in the form of a plurality of intersecting axially and circumferentially extending grooves. A shoe is arranged in close fitting, mating engagement with an arcuate segment of the peripheral surface of the drum. The shoe has a molten lead passageway therein which communicates with the peripheral surface of the drum by means of an orifice slot extending lengthwise of the shoe and across the drum. Molten lead under superatmospheric pressure is directed into a tube extending lengthwise within the lead passageway in the shoe and provided with a plurality of openings spaced lengthwise of the tube. The lead is discharged through these openings into the lead passageway, through the orifice slot and against the surface of the drum. The orifice slot has an upstream edge inclined slightly to the axially extending grooves on the battery grid cavity pattern on the drum. The arcuate surface of the shoe which contacts the peripheral surface of the drum is formed with pockets in which lead solidifies to form a seal between the drum and the shoe.

19 Claims, 15 Drawing Figures

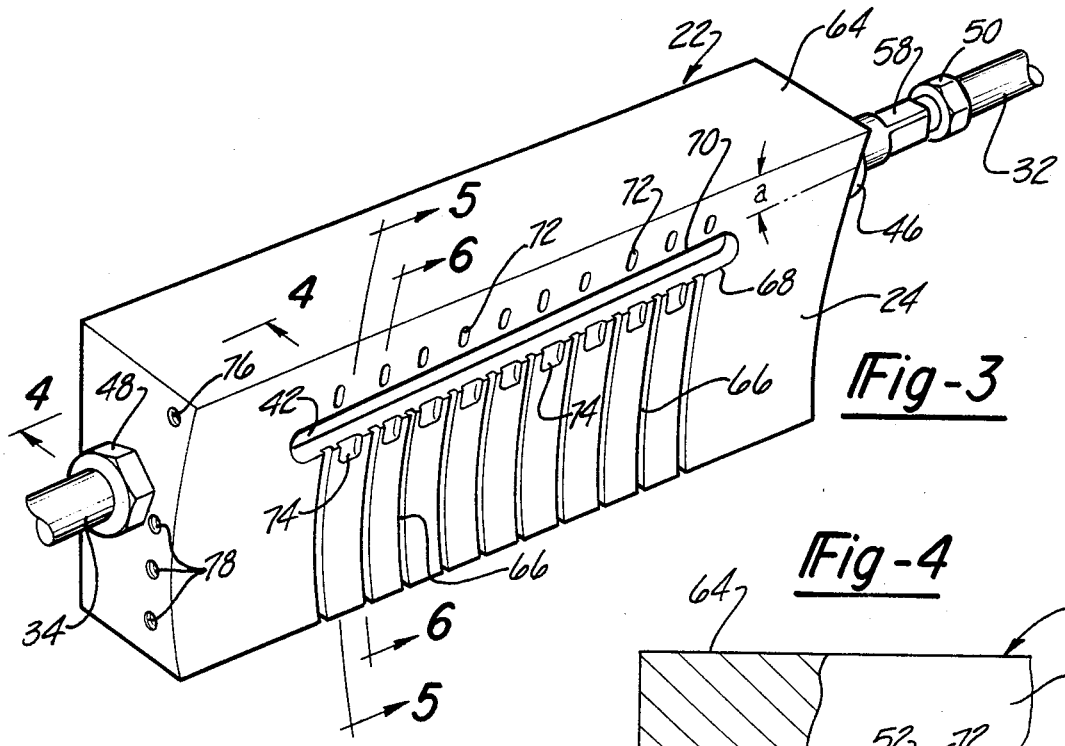
Fig-3
Fig-4
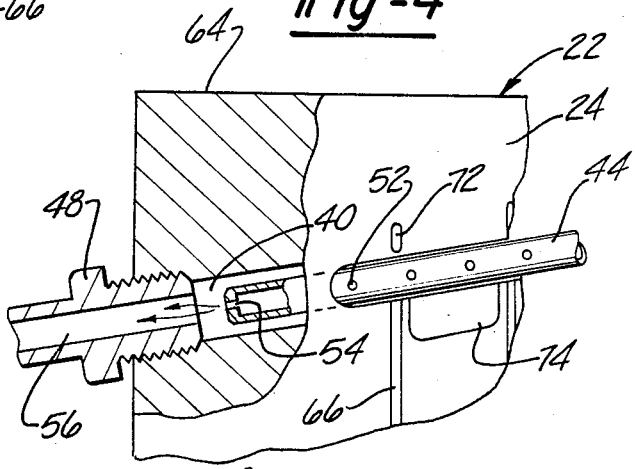
Fig-5
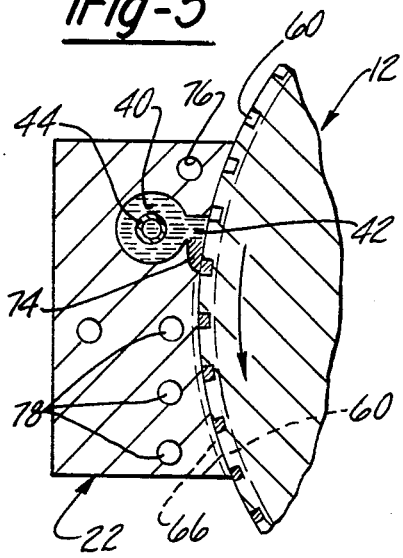
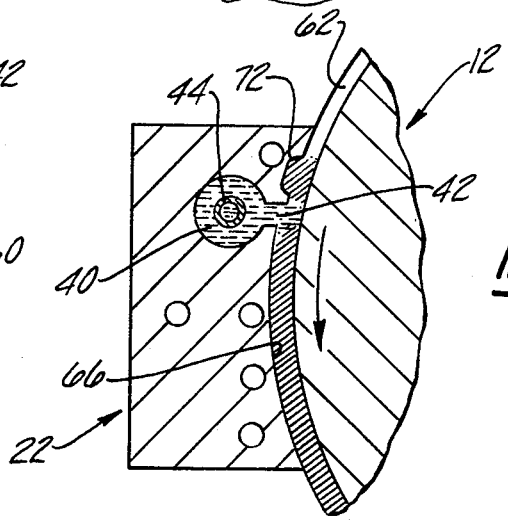
Fig-6
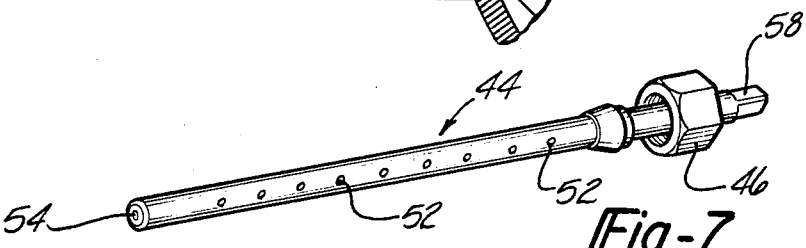
Fig-7

Fig-8
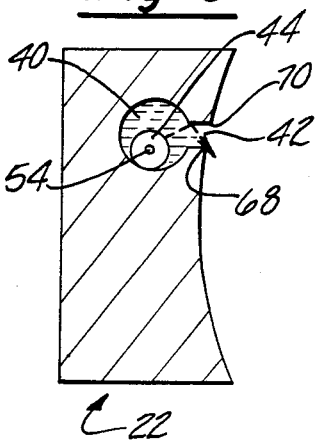
Fig-9
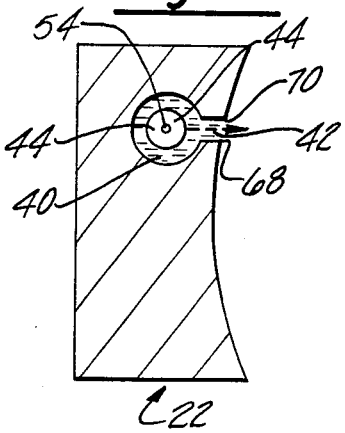
Fig-10
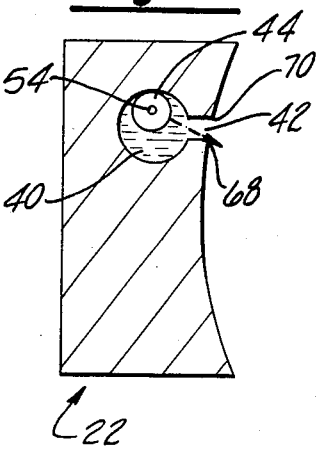
Fig-11
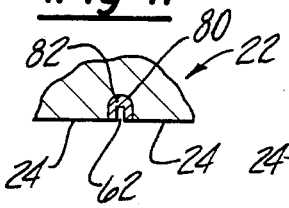
Fig-12
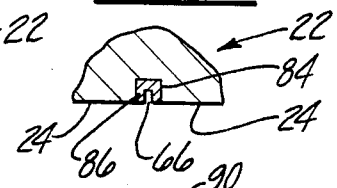
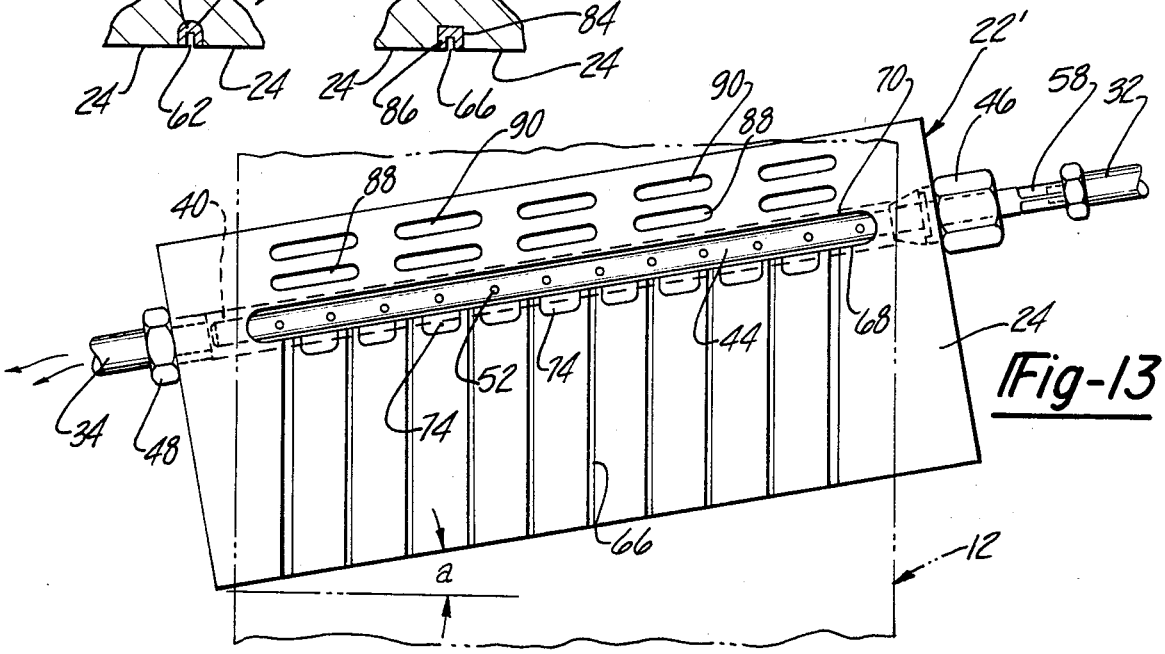
Fig-13
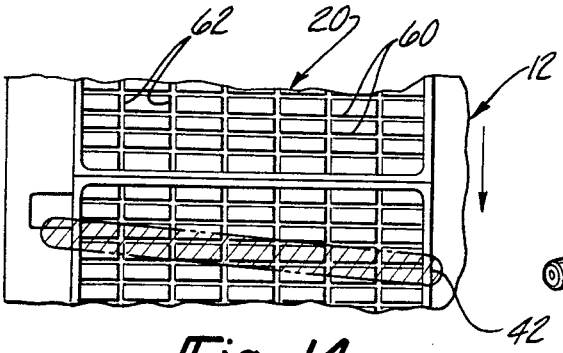
Fig-14
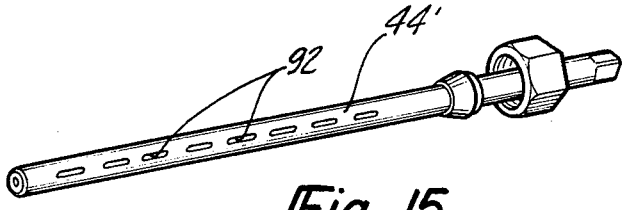
Fig-15

MACHINE FOR CONTINUOUSLY CASTING BATTERY GRIDS

FIELD OF THE INVENTION

This invention relates to a rotary drum type machine for continuously casting battery grids and, more particularly, to a shoe for use with the drum.

BACKGROUND OF THE INVENTION

In U.S. Pat. No. 4,349,067, assigned to the assignee of this application, there is disclosed a machine for continuously casting battery grids. The machine generally consists of a cylindrical drum having the battery grid pattern machined as a cavity on the surface thereof and a shoe extending around a small circular segment of the drum and having a lead passageway therein. Molten lead directed into the passageway is caused to flow into the grid cavity on the drum through an orifice slot communicating with the lead passageway extending across the grid cavity on the drum. While the machine disclosed in the aforementioned patent has been used successfully for casting battery grids, experience has shown that, after the machine has been operated for a short period of time, it has to be stopped because the quality of the grids being cast begins to deteriorate. This decrease in quality results from incomplete filling of the cavity grooves in the drum, flashing between and around the cast wires of the grid, dross inclusion in the grid wires, etc. It is believed that these problems arise primarily because of the non-uniform temperature of the molten lead along the length of the orifice slot in the shoe.

SUMMARY OF THE INVENTION

The present invention has for its primary object the provision of a battery grid casting machine capable of operating continuously over a prolonged time interval, for example, eight hours or more, without requiring shut-down for servicing.

A more specific object of this invention resides in the provision of a shoe arrangement for the drum that is designed to maintain a uniform lead temperature throughout the extent of the orifice slot.

A further object of the invention is to provide a shoe which is designed to insure complete filling of the wire grooves on the drum and prevent flashing and the inclusion of dross in the grid wires.

In general, the shoe of the present invention has a lead passageway therethrough formed with an orifice slot which is open to the peripheral surface of the drum and extends transversely of the drum. Within the lead passageway there is arranged a tube to which the molten lead is directed under superatmospheric pressure in an amount in excess of that required to progressively fill the grid cavity on the drum as it rotates past the orifice slot. The tube has a plurality of apertures spaced along its length through which the molten lead is discharged. The distal end of the tube is also formed with an opening for directing molten lead directly into the outlet of the lead passageway in the shoe to which is connected a lead return line. The orifice slot has an upstream edge inclined at a slight angle to the axially extending wire grooves on the drum so that the successive grooves are filled progressively from one end thereof. The shoe may also be provided with pockets on the drum-engaging surface thereof in which lead is permitted to solidify and form a seal between the shoe and the drum.

With the above-described arrangement a substantially uniform temperature of the lead is maintained throughout the extent of the orifice slot and, as a consequence, grids of consistently high quality are produced over a prolonged period of machine operation.

BRIEF DESCRIPTION OF THE DRAWINGS

Other objects, features and advantages of the present invention will become apparent from the following description and accompanying drawings, in which:

FIG. 3 is a perspective view of a shoe according to the present invention;

FIG. 4 is a fragmentary sectional view taken along the lines 4—4 in FIG. 3;

FIG. 5 is a sectional view taken along the lines 5—5 in FIG. 3;

FIG. 6 is a sectional view taken along the lines 6—6 in FIG. 3;

FIG. 7 is a perspective view of the lead flow tube within the shoe;

FIGS. 8, 9 and 10 illustrate the various positions in which the tube within the shoe can be adjusted;

FIGS. 11 and 12 are fragmentary sectional views showing two different methods of forming the wire forming grooves in the shoe;

FIG. 13 is another embodiment of a shoe according to the present invention;

FIG. 14 is a view showing the relative orientation of the orifice slot in the shoe in relation to the grid pattern cavity on the drum; and FIG. 15 is a perspective view of a modified form of tube.

DESCRIPTION OF THE PREFERRED EMBODIMENTS

Figure 1:
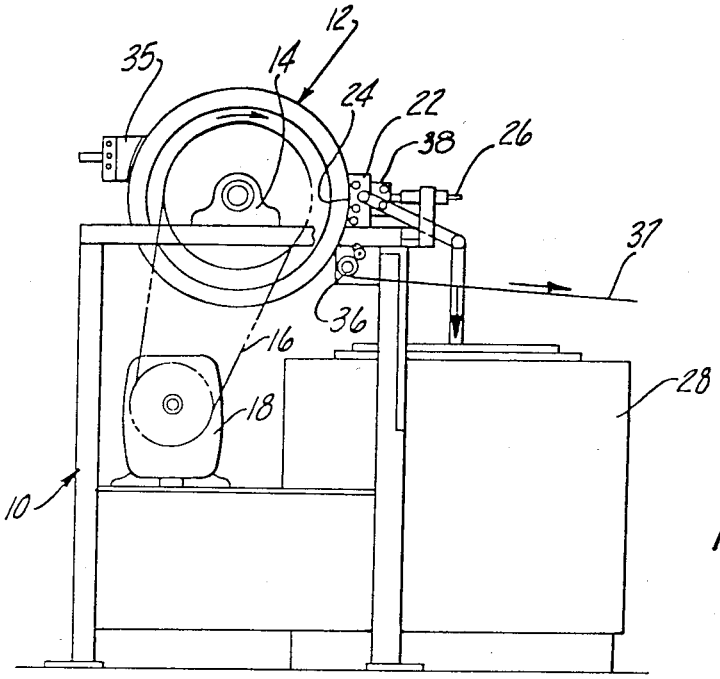
FIG. 1 is a side elevational view of a battery grid casting machine embodying the present invention.
Figure 2:
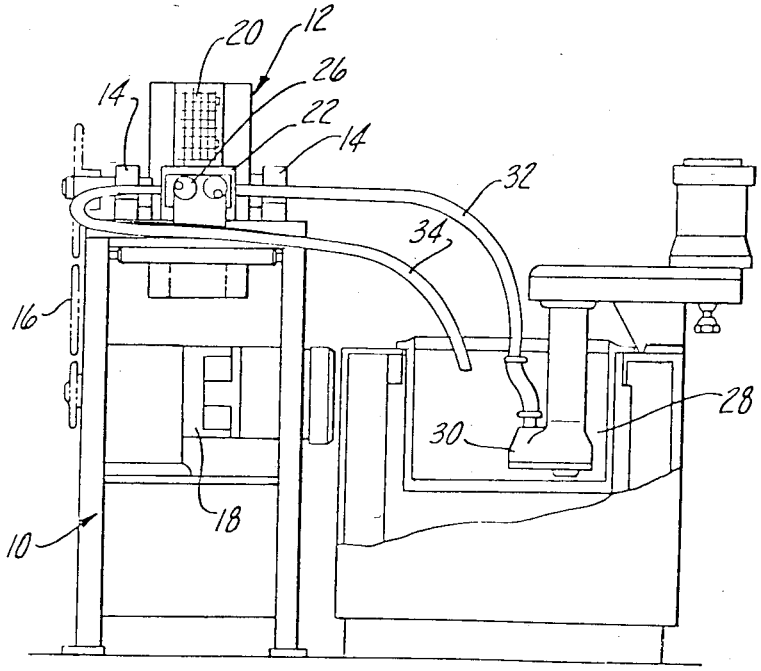
FIG. 2 is an end view of the machine illustrated in FIG. 1.

The general construction of a machine for continuously casting battery grids according to the present invention is illustrated in FIGS. 1 and 2. It consists of a frame 10 on which a battery grid casting drum 12 is journalled for rotation in pillow blocks 14. Drum 12 is rotated by means of a suitable belt or chain drive 16 from a variable speed motor 18. The outer peripheral surface of drum 12 has a cavity 20 conforming to the battery grid pattern machined therein. Against one side of drum 12 there is positioned a shoe 22 having an arcuate surface 24 which is maintained in pressure-mating engagement with the outer peripheral surface of drum 12 by clamp screws 26. Molten lead under pressure is directed from a lead pot 28 by means of a motor-driven pump 30 through an inlet conduit 32 to shoe 22. The excess lead is returned from the shoe to the lead pot through a return line 34. On the side of drum 12 opposite shoe 22 there is arranged a series of thermostatically controlled water spray nozzles 35 for maintaining the outer peripheral surface of the drum at a desired temperature, for example, about 350° F. The connected cast grids are stripped from the drum around a roller 36 as a continuous web 37 which is thereafter pasted and severed into individual grids.

One form of shoe according to the present invention is illustrated in FIGS. 3 through 10. Shoe 22 is formed of a block of metal, such as aluminum-bronze, having high heat conductivity. The radially outer face of the block (that is, the face opposite the arcuate surface 24) has a heater block 38 secured thereto as shown in FIG. 1. A lead passageway 40 extends lengthwise within the shoe from one end to the other. An orifice slot 42 is machined in the arcuate surface 24 of the shoe. Orifice slot 42 communicates with passageway 40 and extends lengthwise thereof.

Within passageway 40 there is arranged a tube 44 having a cross section smaller than the cross section of passageway 40. A fitting 46 adjacent the inlet end of tube 44 is secured in sealed engagement with one end of passageway 40. The opposite end of passageway 40 is connected by an outlet fitting 48 with return line 34 to the lead pot. The inlet line 32 from the lead pot is connected to the outer end of tube 44 by means of a fitting 50. Tube 44 has a plurality of radially oriented apertures 52 extending therethrough and spaced lengthwise of the tube. The end of tube 44 within passageway 40 terminates inwardly of fitting 48 and has an opening 54 therein aligned axially with the bore 56 of fitting 48. The outer end of tube 44 is formed with a non-circular portion 58 or is provided with other suitable means adapted to be engaged by a tool for rotating tube 44 about its axis while it is mounted within the shoe.

Referring now to FIG. 14 wherein the peripheral surface of drum 12 is illustrated, it will be observed that the battery grid pattern 20 comprises a plurality of axially extending, circumferentially spaced grooves 60 and a plurality of circumferentially extending, axially spaced grooves 62. The vertically extending grooves 62 are deeper than the horizontally extending grooves 60. There is also shown in FIG. 14 an outline of the orifice slot 42 of shoe 22 and its orientation relative to the horizontally extending grooves 60 in the drum. It will be observed that the orifice slot 42 extends substantially the full width of a grid pattern 20 and that it is inclined at a slight angle relative to the horizontal grooves 60 in the drum. The shoe illustrated in FIG. 3 is constructed such that, when arranged on the drum, its upper flat face 64 extends parallel to the axis of rotation of the drum. Thus, the orifice slot 42, and preferably also passageway 40, are formed in the shoe so that their longitudinal axes are inclined to the top face 64 at a slight angle a. The magnitude of the angle a is between about 5° to 15°. An inclination of the orifice slot 42 relative to the horizontally extending grooves 60 of about 5° has proven to be very satisfactory.

In most battery grids it is preferred to have the wires formed by the vertical grooves 62 extend both above and below the plane of the wires formed by grooves 60. Shoe 22 is also formed on surface 24 with a plurality of grooves 66 which register axially with grooves 62. Grooves 66 extend on shoe 22 in a downstream direction (relative to the direction of rotation of the drum) from the downstream edge 68 of orifice slot 42. In the embodiment illustrated, slot 42 is of uniform width and, accordingly, the upstream edge 70 of slot 42 is parallel to the downstream edge 68 thereof. Since slot 42 is of uniform width, it follows that grooves 66 which register with the circumferentially extending grooves 62 on the drum are slightly non-perpendicular to the longitudinal axis of slot 42.

The arcuate face 24 of shoe 22 is also formed with a plurality of pockets or slots 72 each of which is vertically aligned with a groove 66. Pockets 72 are spaced slightly upwardly from the upstream edge 70 of orifice slot 42. Between each of the grooves 66 the arcuate face surface 24 of the shoe is also formed with a series of pockets 74. For reasons hereinafter explained, pockets 72 and pockets 74 are preferably at least slightly deeper than grooves 66. Shoe 22 is also formed with a coolant passageway 76 extending lengthwise therethrough behind pockets 72 and similar cooling passageways 78 in the lower portion thereof on the downstream side of orifice slot 42.

In operation the pump 30 is operated to direct molten lead through conduit 32 at superatmospheric pressure and at a rate greater than necessary to fill grooves 60,62 as they rotate past orifice slot 42. Thus, after operation of the machine is initiated, the portion of passageway 40 surrounding tube 44 is completely filled with molten lead which is discharged from tube 44 through openings 52,54. Tube 44 acts as a heat sink within passageway 40. In one respect tube 44 acts in a manner similar to an electric cartridge heater positioned in passageway 40 adjacent the orifice slot 42. Since tube 44 is completely surrounded by molten lead throughout its length, the temperature of the lead within the tube is relatively uniform from one end to the other. Likewise, the temperature of the molten lead surrounding tube 44 is relatively uniform throughout the length of passageway 40, even though there is a temperature gradient between shoe 22, the molten lead passageway 40 and the molten lead in tube 44.

The number and spacing of holes 52 in tube 44 is such that there is a uniform distribution of molten lead to all parts of the grid cavity 20. Each section of the grid is exposed to fresh, uncontaminated lead issuing substantially directly from the holes 52 without any substantial heat loss or dross. This uniform distribution of lead at a substantially uniform temperature throughout the transverse extent of the grid cavity coupled with the inclination of the orifice slot 42 insures a complete filling of all of the grooves of the grid pattern. From FIG. 14 it will be observed that, since the orifice slot 42 is inclined at a slight angle to the horizontal grooves 60, it follows that grooves 60 register with the upstream edge 70 of orifice slot 42 in a progressive manner from one end to the other (from left to right as viewed in FIG. 14). If the orifice slot is parallel to the axis about which the drum is rotated, the horizontal grooves 60 are exposed to the lead in the orifice slot instantaneously throughout their length. When the machine operates in that manner the filling procedures causes filling problems and gas or dross inclusions in the grid. When the orifice slot is inclined at a slight angle to the horizontal grooves 60, these grooves are filled progressively from one end and, thus, permit evacuating the air out of the other end. A more consistent and complete filling of the wire-forming grooves is accomplished.

As pointed out previously, the opening 54 in the end of tube 44 is located so that the lead discharged from the end of the tube flows directly into the fitting 48 for the return line 34. Experience has shown that without the hole 54 there is a tendency for the return line fitting 48 to plug-up with dross and lead build-up which causes the lead flow to stop after a short period of time. The provision of the opening 54 results in the flow of enough lead at a sufficiently high velocity and high temperature to prevent lead solidification and to wash clean the return line fitting. This flushing action with high temperature lead results in much improved and longer casting runs.

Another advantage resulting from the provision of tube 44 resides in the fact that the tube can be located in various positions within passageway 40 to obtain various lead impingement points for the streams issuing from apertures 52. This is very beneficial in casting different lead alloys. For example, as shown in FIG. 8, if it is desired to cool the lead somewhat before directing it into the grid cavity on the drum, tube 54 can be positioned adjacent the lower side of passageway 40 and rotated so that the apertures 52 are oriented to direct the streams of lead upwardly toward the upstream edge of orifice slot 52. By the same token, in casting other lead alloys it may be desirable to position tube 44 adjacent the upper side of passageway 40 and rotate the tube so that the orifices are oriented so as to direct the lead issuing therefrom in a downwardly direction toward the lower edge of the orifice slot. In other instances it is most desirable to locate tube 40 generally at the center of passageway 40 as shown in FIG. 9 and rotate the tube such that the apertures 52 are oriented in a desired radial direction. It will be appreciated that in the event there is a tendency for the lead to build-up and become partially solidified along the downstream edge of the orifice slot, the tube can be rotated periodically and for a short interval while the machine is operating to direct hot molten lead in this direction and, thus, wash away any lead accumulation that might tend to build up in the orifice slot. Rotation of the tube 44 to obtain the desired orientation of apertures 52 even when the machine is operating is facilitated by the fact that it is formed with a non-circular portion 58 which can be engaged with a suitable turning tool.

With some types of lead alloys it is desirable to form a lead seal between the shoe and drum along the lower edge of the orifice slot. This seal compensates for any misalignment between the drum and the downstream edge of the orifice slot. Since the lead is at superatmospheric pressure, the downstream edge of the orifice slot should be in intimate contact with the peripheral surface of the drum at all times, otherwise the lead would leak out from between the wheel and the shoe and cause flashing. This intimate contact between the downstream edge of the orifice slot and the peripheral surface of the drum is also necessary because this edge of the orifice slot is utilized to scrape solidified lead off of the surface of the drum as the grid cavity rotates past the orifice slot. In the present arrangement this lead seal is provided by pockets 74. These pockets are sufficiently large and sufficiently cooled to cause the molten lead to freeze therein and remain in place. In the embodiment illustrated in FIGS. 3 and 5 pockets 74 are each formed as a single groove with an arcuate rounded end. Each pocket can also be formed as a series of circumferentially spaced, machined steps. In any event, the pockets must be so positioned that the lead freezes therein and is not washed out by the lead flow in the orifice slot.

Since the wire-forming grooves 62 extend circumferentially of the drum 12 and since the lead in the orifice slot 42 is at superatmospheric pressure, it follows that as the drum rotates there will be a tendency for the molten lead to flow in an upstream direction through slots 62 so that sections of these slots will become filled with lead before they register with slot 42. It therefore becomes desirable to seal in some fashion the slots 62 on the upstream side of the orifice slot 42. In the present arrangement this is accomplished by the pockets 72 which, as pointed out previously, register axially with grooves 62. Pockets 72 are located along the upstream side of orifice slot 42. Thus, as shown in FIG. 6, a portion of the lead in orifice slot 42 will flow in an upstream direction through grooves 62 and into slots 72. However, the portions of the shoe surrounding slots 72 is at a temperature substantially below the solidification temperature of the molten lead and, therefore, the lead tends to solidify as a solid slug in the pockets 72 and the underlying portions of grooves 62. These solid lead slugs therefore prevent the molten lead from flowing in an upstream direction beyond pockets 72.

With certain types of lead alloys it is desirable to have different cooling rates for the horizontal and vertical wires of the cast grid. This can be provided by forming grooves 66 in inserts formed of a material having a different heat conductivity than the metal from which the shoe 22 is formed. FIGS. 11 and 12 illustrate two different modes of applying such inserts. In FIG. 11 the shoe 22 has large grooves 80 machined in the surface 24 on the downstream side of orifice slot 42. The grooves 80 are filled with a weld bead 82 of different material than the shoe and the grooves 66 are thereafter accurately machined therein. In the arrangement shown in FIG. 12 the arcuate surface 24 has a rectangularly-shaped groove 84 machined therein and correspondingly shaped inserts 86 are press-fitted in grooves 84. The arcuate slots 66 are formed in inserts 84 either before or after being press-fitted in the shoe. If it is desired to cool the vertical wires of the grid at a faster rate than the horizontal wires, then the weld bead 82 or the inserts 84 can be formed of such metal as titanium or vanadium. It is also very desirable that the material used to form the weld beads 82 or inserts 84 is one which is non-wetting with the lead.

The shoe arrangement shown in FIG. 13 differs only slightly from that shown in FIG. 3. In FIG. 13 shoe 22' is likewise of generally rectangular shape, but the arcuate surface 24 is ground thereon so that when the shoe is arranged on the drum with the arcuate surface 24 in mating engagement with the outer peripheral surface of the drum, the longitudinal axis of the shoe is inclined with respect to the rotary axis of the drum. This, in this arrangement the shoe 22' itself is inclined to the axis of the drum at a slight angle of between 5° and 15° and the orifice slot 42 is parallel with the upper and lower edges of the shoe. When the shoe 22' is arranged on the drum, the orifice slot 42 will be oriented with respect to the horizontal wires 60 of the grid cavity in the manner illustrated in FIG. 14.

In the shoe illustrated in FIG. 13 there is formed a series of elongated pockets 88,90 spaced upstream from the upstream edge 70 of orifice slot 42. Slots 88, 90 are arranged in two parallel rows spaced circumferentially apart as illustrated. Each slot has a length such as to axially span two or more circumferentially extending grooves 62 on the drum. Pockets 88,90 perform essentially the same function as pockets 72 in the embodiment illustrated in FIG. 3. They are larger in size than the pockets 72 and the lead tends to solidify therein more readily than in pockets 72.

The tube 44' shown in FIG. 13 is essentially the same as tube 44 illustrated in FIG. 7, except, however, that apertures 92 therein are in the form of axially elongated slots rather than circular apertures such as shown at 52 in FIG. 7. As pointed out previously, the size, spacing and number of the apertures in tube 44 or 44' will vary with the grid size and the lead alloy being cast.

It will be understood that in operation of the machine the drum is cooled to a temperature substantially below that of the shoe and that at the surface of the shoe in mating engagement with the drum the temperature of the shoe is below the solidification temperature of the lead alloy being cast. For example, in the case of an antimony-lead alloy which solidifies at about 565° F., it may be admitted to the shoe at a temperature of about 720° C. The drum is maintained at a temperature of about 250° F. and the temperature of the shoe as measured by a thermocouple located slightly below passageway 40 and slightly inwardly of surface 24 might be maintained at about 600° F. However, the cooling effect of the drum on the surface 24 will be sufficient to lower the temperature of the shoe directly adjacent the surface 24 to below the solidification temperature; for example, to a temperature of between 325° and 350° F. The temperature of the shoe immediately adjacent the passageway 40 must be sufficiently high to maintain the lead in a free-flowing condition as distinguished from a semi-solid or slushy condition. It is the cooling effect of the drum on the shoe which causes the lead to solidify in grooves 66 and pockets 72, 74, 88, 90.

We claim:

1. In a machine for continuously casting battery grids wherein a battery grid pattern is formed as a cavity around the peripheral surface of a rotating cylindrical drum and lead is directed into the cavity by means of a shoe in mating engagement with the peripheral surface of the drum and having a molten lead passageway therein which opens to the surface of the drum by means of an orifice slot extending transversely across the drum, that improvement which comprises a tube extending lengthwise within said passageway, said tube having a cross section substantially smaller than said passageway and having a plurality of discharge apertures therein spaced lengthwise thereof and means for directing molten lead to said tube at superatmospheric pressure and in an amount in excess of that required to progressively fill the grid cavity as it rotates past the orifice slot.

2. A machine as called for in claim 1 wherein said discharge apertures are arranged in a generally straight row along the length of said tube.

3. A machine as called for in claim 2 wherein the tube is rotatably adjustable about its longitudinal axis within said passageway to vary the radial orientation of the streams of lead issuing from said discharge apertures relative to said orifice slot.

4. A machine as called for in claim 1 wherein said shoe has an inlet at one end of said passageway and an outlet at the opposite end of the passageway, said tube extending into said passageway through said inlet, the distal end of said tube having an opening therein aligned generally axially with said outlet.

5. A machine as called for in claim 4 wherein the distal end of said tube terminates within said passageway adjacent, but spaced inwardly from, said outlet.

6. A machine as called for in claim 4 wherein said outlet extends generally axially with respect to said passageway and said opening in the end of said tube extends generally axially with respect to said tube.

7. A machine as called for in claim 4 wherein said opening in the end of the tube is sufficiently small in relation to the pressure of the lead directed into the tube and the number and size of said discharge apertures are such as to cause molten lead to issue from said end opening as a stream which flows directly into said outlet opening of said passageway.

8. A machine as called for in claim 1 wherein said grid cavity comprises a plurality of axially spaced, circumferentially extending grooves and a plurality of circumferentially spaced, axially extending grooves on the peripheral surface of the drum, said orifice slot having an upstream edge axially inclined relative to the axially extending grooves on the drum.

9. A machine as called for in claim 8 wherein said upstream edge of the orifice slot is inclined to said axially extending grooves at an angle of between about 5° to 15°.

10. A machine as called for in claim 9 wherein said angle is about 5°.

11. A machine as called for in claim 9 wherein said shoe is formed with a plurality of grooves extending in a downstream direction from the downstream edge of the orifice slot, said last-mentioned grooves being axially aligned with the circumferentially extending grooves on the drum.

12. A machine as called for in claim 1 wherein said grid cavity comprises a plurality of axially spaced, circumferentially extending grooves and a plurality of circumferentially spaced, axially extending grooves on the peripheral surface of the drum, said shoe having a plurality of recesses on the surface thereof which is in mating engagement with the drum, said recesses being located on the upstream side of the orifice slot and registering with the circumferentially extending grooves on the drum.

13. A machine as called for in claim 12 wherein said recesses in the surface of the shoe correspond in number and spacing with the circumferentially extending grooves on the drum.

14. A machine as called for in claim 1 wherein said grid cavity comprises a plurality of axially spaced, circumferentially extending grooves and a plurality of circumferentially spaced, axially extending grooves on the peripheral surface of the drum, said shoe having on the surface thereof which is in mating engagement with the drum a plurality of grooves extending downstream from the downstream edge of said orifice slot, said last-mentioned grooves being axially aligned with the circumferentially extending grooves on the drum, said shoe having a plurality of metal bodies recessed into said surface and extending in a downstream direction from the downstream edge of said orifice slot, said metal bodies registering axially with and being slightly wider than the circumferentially extending grooves on the drum, said grooves on the shoe being formed in said metal bodies, said bodies being formed of a metal having a heat conductivity rate different from that of the metal from which the shoe is formed, the portions of the shoe between said metal bodies registering axially with the portion of the axially extending grooves on the drum extending between the circumferential grooves on the drum.

15. A machine as called for in claim 14 wherein said metal bodies comprise weld metal.

16. A machine as called for in claim 14 wherein said metal bodies comprise inserts in said surface of the shoe.

17. A machine as called for in claim 1 wherein said grid cavity comprises a plurality of axially spaced, circumferentially extending grooves and a plurality of circumferentially spaced, axially extending grooves on the peripheral surface of the drum, said shoe having on the surface thereof which is in mating engagement with the drum a plurality of grooves extending downstream from the downstream edge of said orifice slot, said last-mentioned grooves being axially aligned with the circumferentially extending grooves on the drum, said surface of the shoe having a plurality of recesses therein along the downstream edge of said orifice slot, said recesses extending laterally between said grooves in the shoe.

18. In a machine for continuously casting battery grids wherein the battery grid pattern is formed as a cavity around the peripheral surface of a rotating cylindrical drum, said grid cavity comprising a plurality of axially spaced, circumferentially extending grooves and a plurality of circumferentially spaced, axially extending grooves on the peripheral surface of the drum and lead is directed into the grid cavity by means of a shoe in mating engagement with the peripheral surface of the drum and having a molten lead passageway therein which is open to the surface of the drum by means of an orifice slot extending transversely across the drum, that improvement which comprises the orifice slot having an upstream edge which is inclined axially at a slight angle to the axially extending grooves on the drum in the range of about 5° to 15° and means for directing molten lead into said passageway at superatmospheric pressure and in an amount in excess of that required to progressively fill the grid cavity as it rotates past the orifice slot.

19. A machine as called for in claim 18 wherein the upstream edge of the orifice slot is inclined at an angle of about 5° to the axially extending grooves on the drum.

* * * * *